US006269567B1

(12) United States Patent
MacPherson et al.

(10) Patent No.: US 6,269,567 B1
(45) Date of Patent: Aug. 7, 2001

(54) DIFFUSING SCREEN WITH MATTE REGION

(75) Inventors: David Miller MacPherson, Paris; Kristoffer Hess; Ignazio Gallo, both of Cambridge; Sean David Spencer, Chatsworth, all of (CA)

(73) Assignee: Dimplex North America Limited, Cambridge (CA)

( * ) Notice: Subject to any disclaimer, the term of this patent is extended or adjusted under 35 U.S.C. 154(b) by 0 days.

(21) Appl. No.: 09/518,684

(22) Filed: Mar. 3, 2000

Related U.S. Application Data

(60) Division of application No. 08/801,469, filed on Feb. 18, 1997, now Pat. No. 6,047,489, which is a continuation-in-part of application No. 08/649,510, filed on May 17, 1996, now Pat. No. 5,642,580.

(51) Int. Cl.[7] ..... G09F 19/00
(52) U.S. Cl. ..... 40/428; 472/65; 392/348
(58) Field of Search ..... 40/428; 362/92, 362/96, 253, 806; 392/348; 472/65

(56) References Cited

U.S. PATENT DOCUMENTS

D. 292,152 10/1987 Meyers .
D. 292,251 * 10/1987 Meyers .

(List continued on next page.)

FOREIGN PATENT DOCUMENTS 0 611 921 A2 4/1994 (EP) .
975009 7/1962 (GB) .
1024047 11/1963 (GB) .
1088577 11/1964 (GB) .
1164143 7/1966 (GB) .
1443772 1/1973 (GB) .
1407926 * 2/1973 (GB) .
1457540 12/1973 (GB) .
1567625 12/1975 (GB) .
2032417 9/1979 (GB) .
2118096 2/1983 (GB) .
2149090 * 6/1984 (GB) .
2151772 A 11/1984 (GB) .
2180927 8/1986 (GB) .
2230335 A 9/1989 (GB) .
2240171 1/1990 (GB) .
2256040 * 5/1991 (GB) .
2264555 * 2/1993 (GB) .
2290865 * 6/1994 (GB) .
9502867 * 2/1995 (GB) .

OTHER PUBLICATIONS

Epri Electric Power Research Institute, Residential Electric Fireplaces Review of the State of the Art, May 1997.

*Primary Examiner*—Brian K. Green

(57) ABSTRACT

A simulated fireplace assembly is provided having a simulated fuel bed and a screen for transmitting an image of a flame. The simulated fuel bed is located adjacent to the screen. The screen has a first region that is sufficiently reflective to reflect the fuel bed and a second region that is sufficiently non-reflective to avoid reflection of ambient subject matter that is not associated with the fireplace assembly.

6 Claims, 14 Drawing Sheets

U.S. PATENT DOCUMENTS

| | | | | |
|---|---|---|---|---|
| 1,199,882 | | 10/1916 | Frey . | |
| 1,938,085 | | 12/1933 | Page . | |
| 2,009,167 | | 7/1935 | Delano . | |
| 2,107,141 | | 2/1938 | Colt . | |
| 2,327,918 | | 8/1943 | Miller . | |
| 3,085,474 | | 4/1963 | Bourgeaus et al. . | |
| 3,499,239 | | 3/1970 | Mungo . | |
| 3,560,093 | | 2/1971 | Montone . | |
| 3,652,370 | | 3/1972 | Motai . | |
| 3,694,945 | | 10/1972 | Detiker . | |
| 3,953,625 | | 4/1976 | Quaintance et al. . | |
| 3,961,434 | | 6/1976 | Sampon . | |
| 3,978,598 | | 9/1976 | Rose et al. . | |
| 4,026,544 | | 5/1977 | Plambeck et al. . | |
| 4,102,101 | | 7/1978 | Nielsen et al. . | |
| 4,167,839 | | 9/1979 | Nielsen et al. . | |
| 4,321,778 | | 3/1982 | Whitehead . | |
| 4,447,995 | | 5/1984 | Fulcher . | |
| 4,573,905 | | 3/1986 | Meyers . | |
| 4,673,609 | | 6/1987 | Hill . | |
| 4,688,548 | | 8/1987 | Stoughton . | |
| 4,883,043 | | 11/1989 | Thow et al. . | |
| 4,890,600 | | 1/1990 | Meyers . | |
| 4,925,705 | | 5/1990 | Hill . | |
| 4,965,707 | * | 10/1990 | Butterfield | 40/428 X |
| 5,195,820 | | 3/1993 | Rehberg . | |
| 5,469,839 | | 11/1995 | Kasulis et al. . | |
| 5,525,177 | | 6/1996 | Ross . | |
| 6,047,489 | * | 4/2000 | Hess et al. | 40/428 |
| 6,050,011 | * | 4/2000 | Hess et al. | 40/428 |

* cited by examiner

DIFFUSING SCREEN WITH MATTE REGION

This is a divisional application based on application Ser. No. 08/801,469, filed Feb. 18, 1997, now U.S. Pat. No. 6,047,489, which was a continuation-in-part application of application Ser. No. 08/649,510, filed May 17, 1996, now U.S. Pat. No. 5,642,580.

FIELD OF THE INVENTION

The present invention relates to flame simulating assemblies for electric fireplaces and the like.

BACKGROUND OF THE INVENTION

Electric fireplaces are popular because they provide the visual qualities of real fireplaces without the costs and complications associated with venting of the combustion gases. An assembly for producing a realistic simulated flame for electric fireplaces is disclosed in U.S. Pat. No. 4,965,707 (Butterfield). Butterfield includes a diffusing screen having a reflective surface for reflecting a simulated fuel source to give the illusion of flames emanating from within the real and reflected images of the fuel source.

A problem with this arrangement of screen is that unwanted images such as the floor or items of furniture or a person standing in front of the electric fireplace are also reflected in the screen. This has the effect of reducing the illusion provided by the fireplace.

SUMMARY OF THE INVENTION

In one aspect, the present invention is directed to a generally transparent screen for use in a flame simulating assembly comprising:

- a body having a partially reflecting surface and a diffusing surface, said surfaces being opposed;
- a matte region located at one portion of said partially reflecting surface, said matte region having a matte finish that is substantially non-reflective; and
- a reflective region located at another portion of said partially reflective surface, said reflective region having a reflective finish.

In another aspect the invention provides a simulated fireplace assembly comprising:

- a simulated fuel bed; and
- a screen adjacent to said simulated fuel bed for transmitting an image of a flickering flame, said screen having a first region that is sufficiently reflective to reflect said fuel bed and a second region that is sufficiently non-reflective to avoid reflection of ambient subject matter that is not associated with said fireplace assembly.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
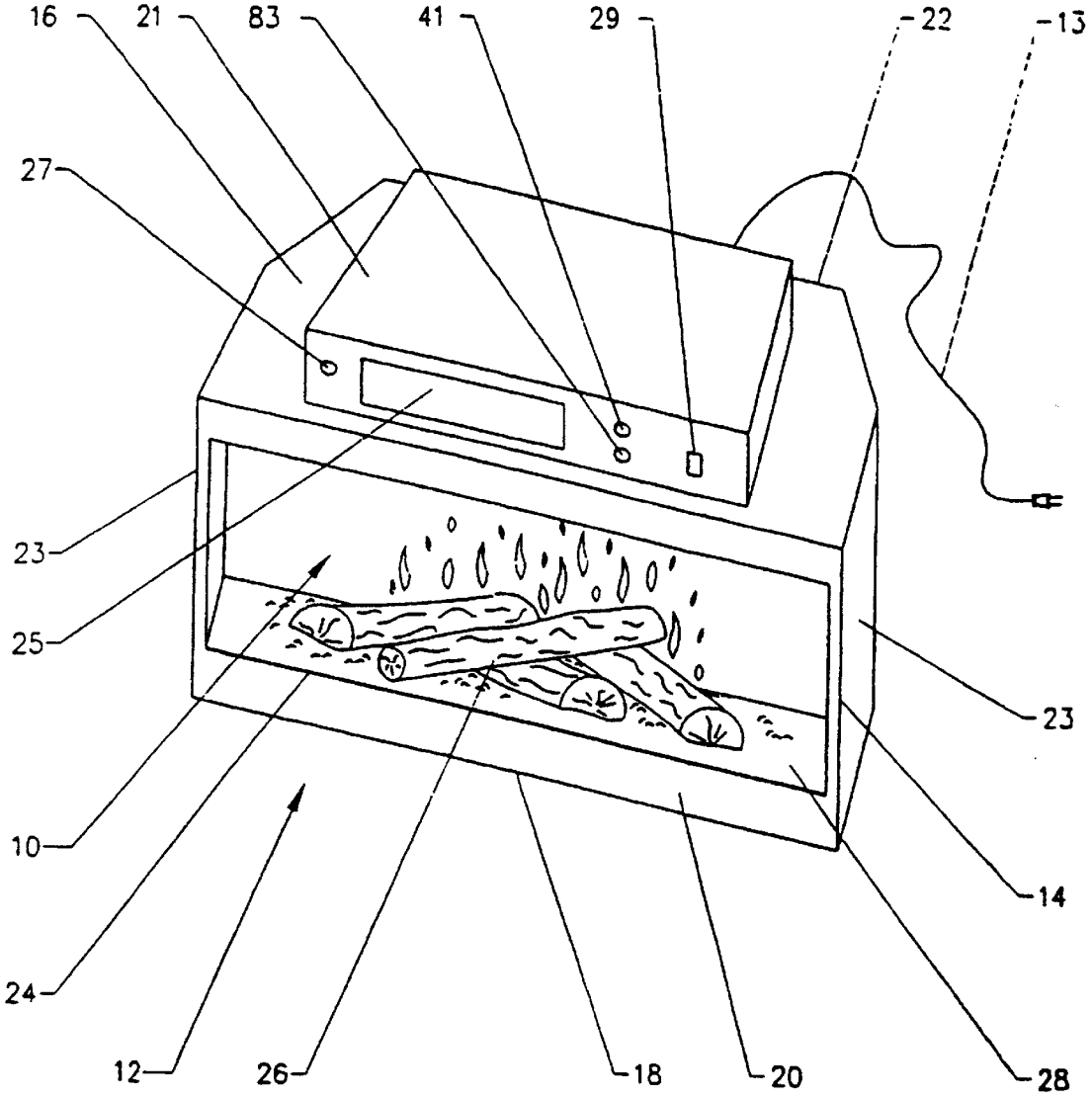
FIG. 1 is a perspective view of an electric fireplace incorporating a flame simulating assembly in accordance with the present invention.

A flame simulating assembly in accordance with the present invention is shown generally at 10 in the figures. The assembly is incorporated within an electric fireplace which is depicted generally at 12 with an electrical connection 13 for connecting to a power source (not shown).

The electric fireplace 12 includes a housing 14 that defines a simulated firebox having top, bottom, front, rear and side walls 16, 18, 20, 22 and 23, respectively. A portion of the front wall is defined by a transparent front panel 24 that is removable to permit access to the contents of the housing 14. A control unit 21 is located above the top wall of the housing. The control unit 21 includes a heater unit 25, a thermostat 27 for controlling the heat output and a main power switch 29 for actuating the flame effect.

Figure 2:
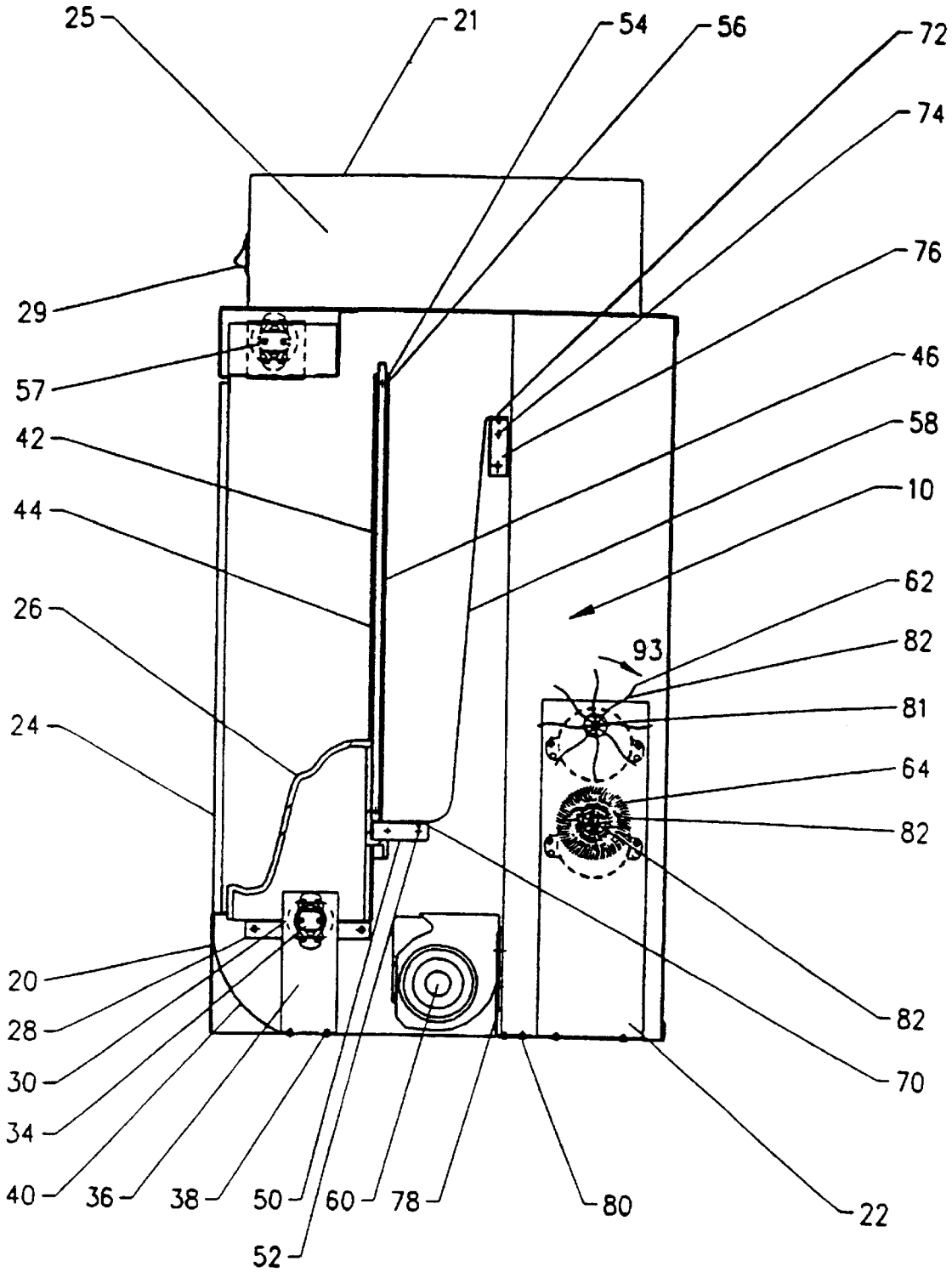
FIG. 2 is a side view of the assembly of FIG. 1 showing elements behind the side wall.
Figure 3:
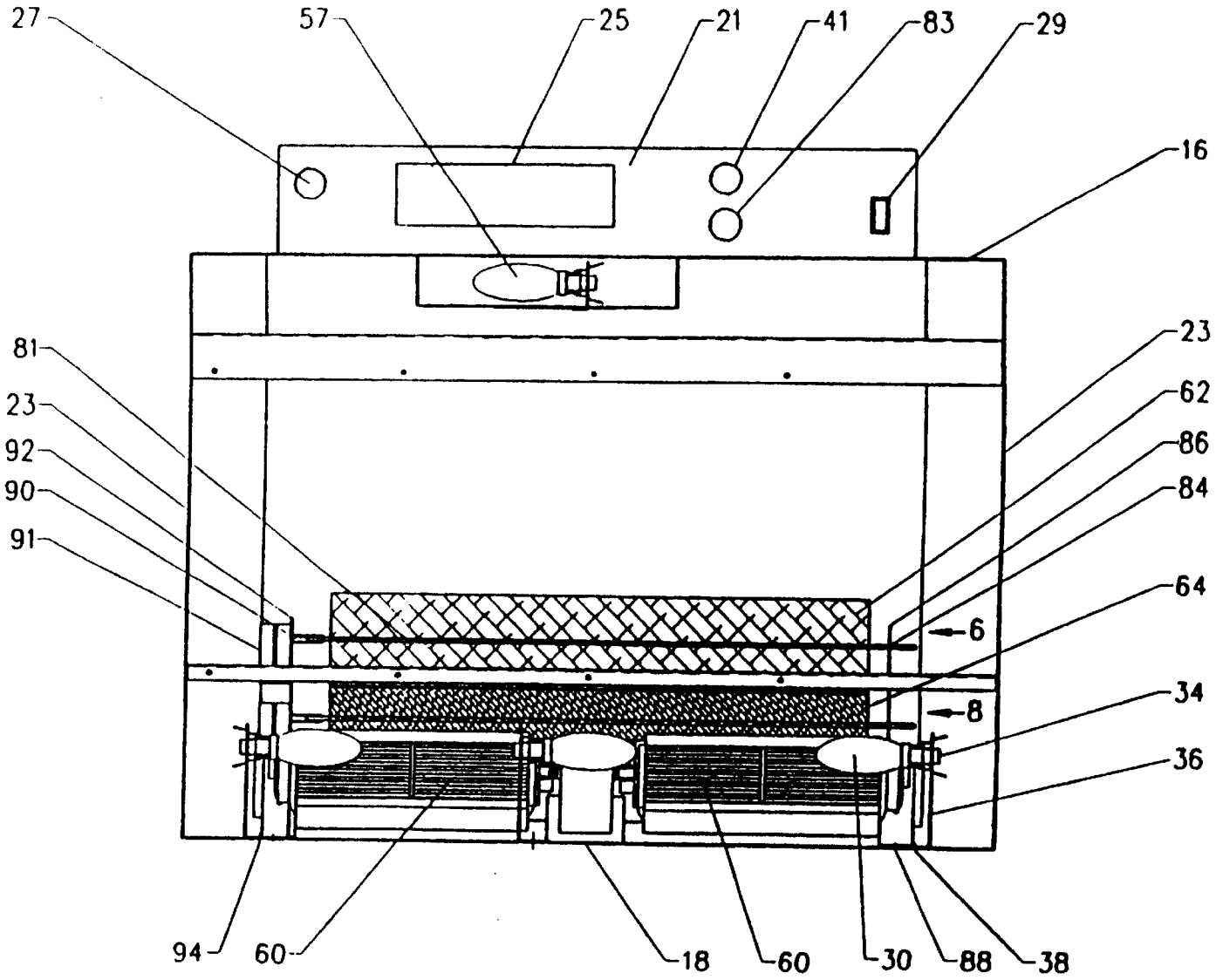
FIG. 3 is a front view of the assembly of FIG. 1 showing elements below the top wall.
Figure 4:
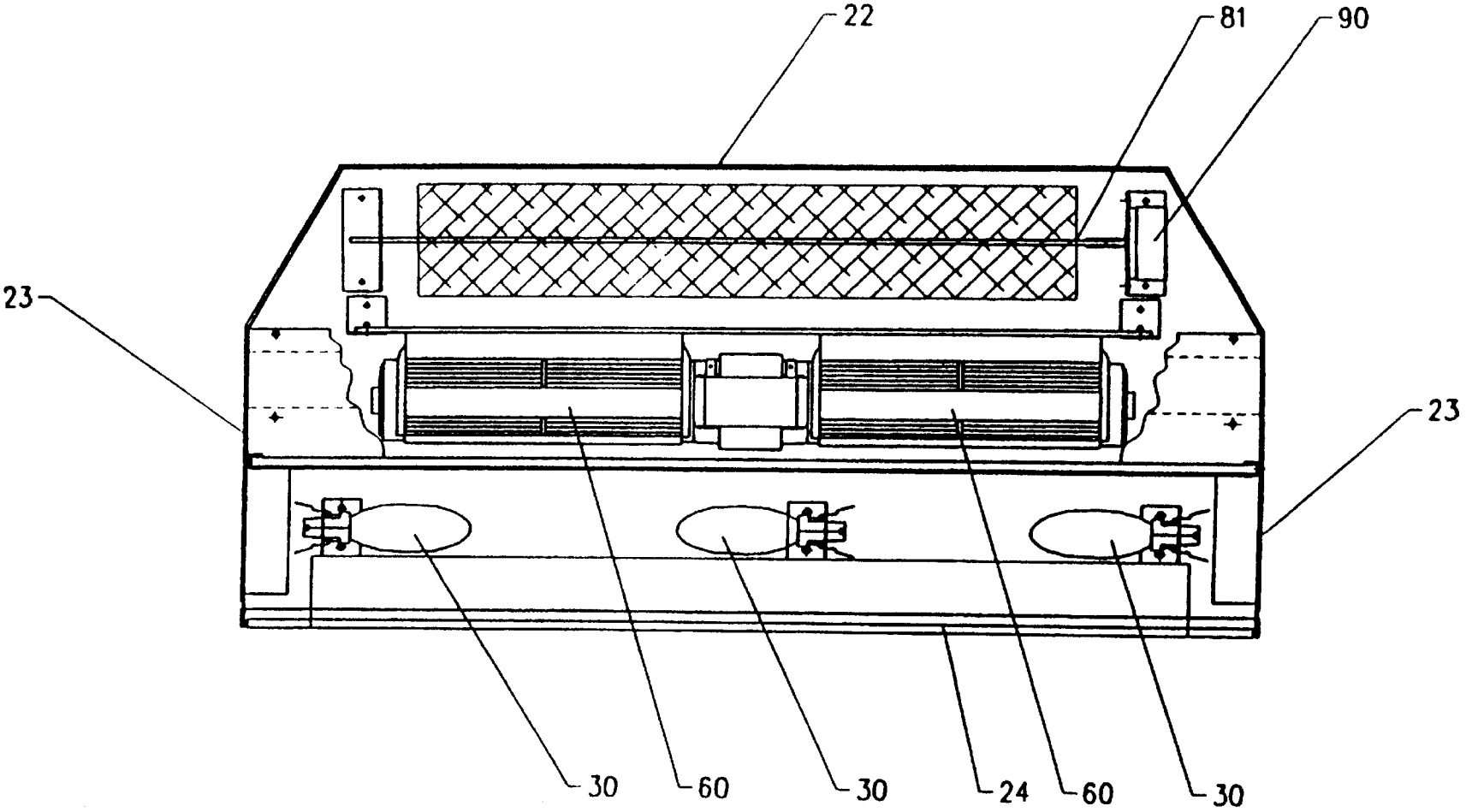
FIG. 4 is a top view of the assembly of FIG. 1 showing elements behind the front wall.

Referring to FIG. 2, a simulated fuel bed 26 is supported on a platform 28 located at a lower front portion of the housing 14. The fuel bed 26 comprises a plastic shell that is vacuum formed and colored to resemble logs and embers for a log burning fire.

Portions of the shell are translucent to permit light from a light source 30 located beneath the fuel bed 26 to shine through. For instance, the shell may be formed from an orange translucent plastic. The top side of the plastic shell may be painted in places to resemble the surface of logs. The underside of the plastic shell may be painted black (or some other opaque color) and then sanded in portions where it is desired for light to pass. For instance, the protruding points on the underside of the shell (corresponding to indents in the top side) may be sanded to allow light passage. These points would thus resemble the embers of a fire. Also, the crotch area between simulated logs may be sanded (or left unpainted) to resemble embers at the intersection of two logs.

The light source 30 comprises three 60 watt light bulbs that are supported in sockets 34 below the fuel bed 26. Alternatively, one or more quartz halogen lights may be utilized. The sockets 34 are supported by vertical arms 36 that are connected with fasteners 38 to the bottom wall of the housing 14. A parabolic reflector 40 is located below the light source 30 at the lower front end of the housing 14 to direct light toward the rear of the housing 14. The intensity of the light can be varied with a dimmer switch 41 that is electrically connected to the light source 30 and located on the control unit 21.

Figure 9:
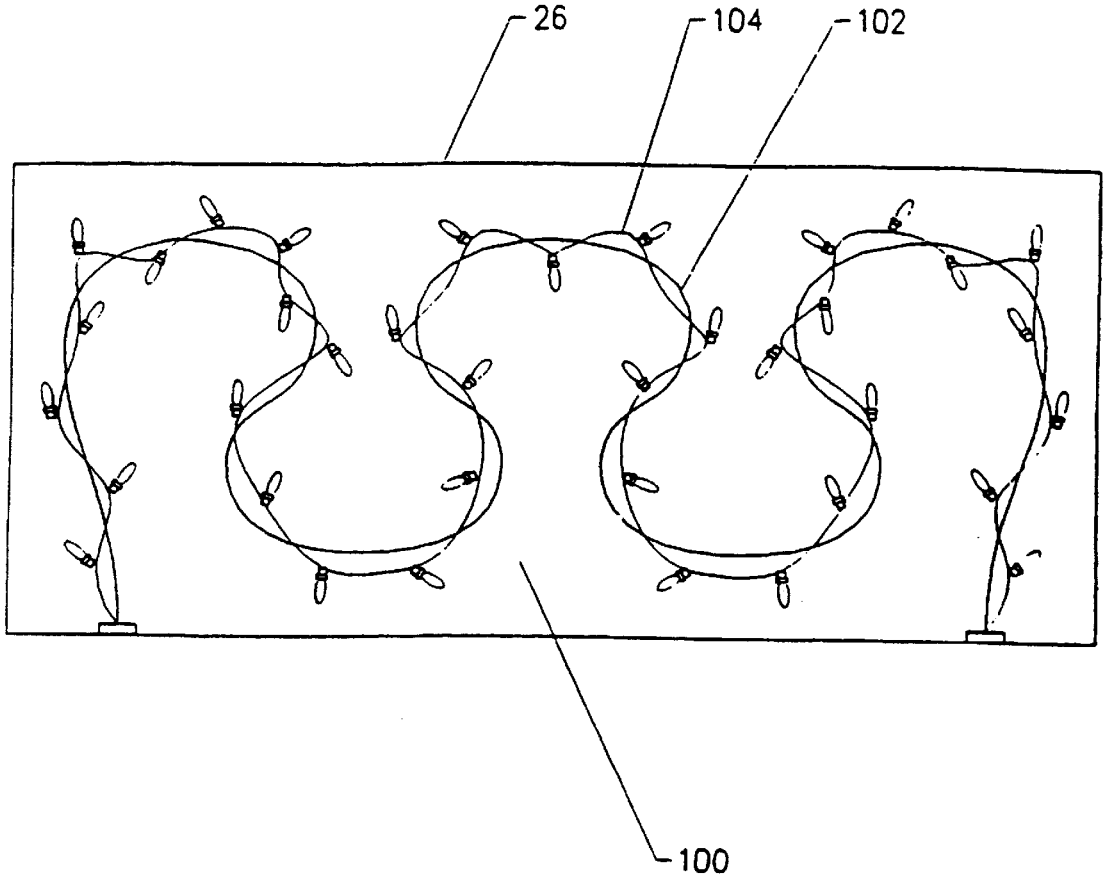
FIG. 9 is a top view of a fuel bed light assembly for the assembly of FIG. 1 in accordance with a further embodiment of the present invention.

In a further embodiment of the invention as shown in FIG. 9, a fuel bed light assembly 100 may be arranged beneath the underside of the fuel bed 26. The fuel bed light assembly 100 includes a support element 102 that supports a string of lights 104 beneath the fuel bed 26. The lights 104 are adapted to flicker at different times to give the impression of increases and decreases in heat (as depicted by differences of light intensity) in the embers of the fuel bed. It has been found that conventional Christmas lights are suitable for this purpose. It has also been found that a realistic ember effect may be generated by positioning four regular light bulbs beneath the bed and randomly varying the intensity of the lights using a micro-processor (not shown).

Located immediately behind the fuel bed 26 is a vertical screen 42. The screen 42 is transparent and has a partially reflecting surface 44 and a diffusing surface 46. The screen 42 is seated in a groove 48 defined in a lower horizontal support member 50. The lower horizontal support member 50 is fastened to the side walls 23 of the housing 14 with fasteners 52. The screen 42 is supported on its sides with side frame members 54 that are fastened to the side walls 23 with fasteners 56. The screen structure is described in more detail in U.S. Pat. No. 4,965,707 which is incorporated herein by reference.

The screen 42 is positioned immediately behind the fuel bed 26 so that the fuel bed 26 will be reflected in the reflecting surface 44 to give the illusion of depth. As will be explained further below, the image of simulated flames appears to be emanating from between the fuel bed 26 and the reflection of the fuel bed 26 in the screen. Also, simulated flames appear to be emanating from the reflected image of the fuel bed 26. An upper light source 57 is located at the top front portion of the housing for illuminating the top of the simulated fuel bed 26 and enhancing the reflected image in the screen 42.

Referring more closely to the flame simulation assembly 10, the assembly includes a flame effect element 58, a blower 60 and upper and lower flicker elements 62 and 64.

Figure 5:
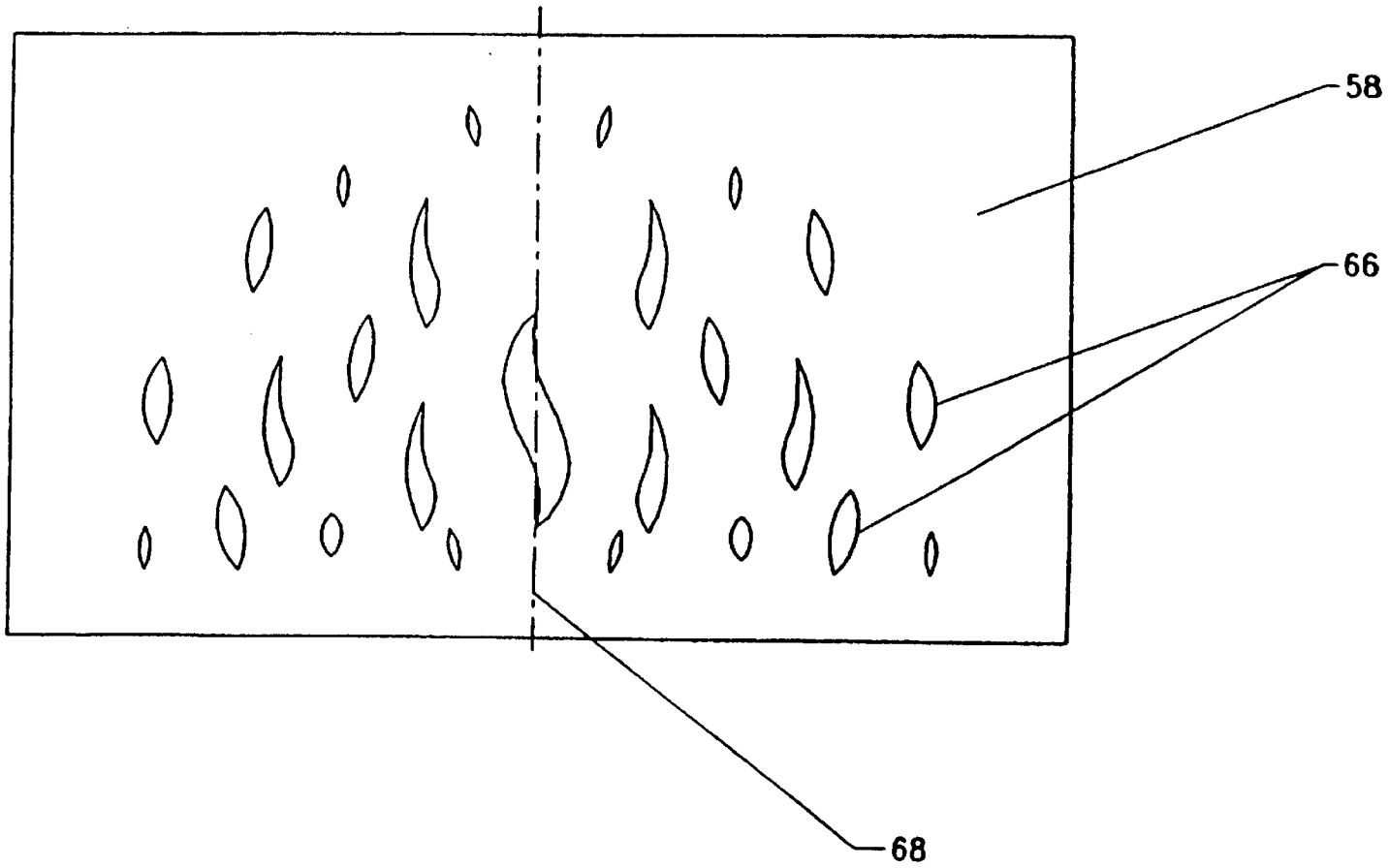
FIG. 5 is a front view of a flame effect element for the assembly of FIG. 1.

As shown in FIG. 5, the flame effect element 58 is formed from a single thin sheet of a light-weight, substantially opaque, material such as polyester. The element 58 extends across substantially the full width of the screen 42. A plurality of slits 66 are cut into the flame effect element 58 to permit passage of light through the flame effect element 58 as it billows under the influence of air currents from the blower 60. Longer sized slits 66 are located at the lower end of the flame effect element 58 to simulate longer flames emanating from the fuel bed 26. Smaller slits 66 are located at the upper end of the flame effect element 58 to simulate the licks of flames that appear above the large main flames emanating from the fuel bed 26. The slits 66 are arranged in a pattern that is symmetrical about a center axis 68 of the flame effect element 58 to give a balanced appearance to the flame effect. The element 58 may be coated with a plastic film (such as polyurethane) to retard fraying about the edges of the slits. Alternatively, the flame effect element could comprise a plurality of discrete flame effect elements 58 as disclosed in U.S. Pat. No. 4,965,707 that is incorporated herein by reference.

The flame effect element 58 is supported at its bottom end by fasteners 70 that connect to the lower horizontal support member 50. The flame effect element 58 is supported at its upper end by fasteners 72 that connect to an upper horizontal support member 74. The upper horizontal support member is connected by fasteners 76 to the side walls of the housing 14.

The flame effect element 58 is supported relatively loosely between the horizontal supports so that it will billow or ripple with the air currents from the blower 60. The blower 60 is supported by a mounting bracket 78 that is supported with fasteners 80 to the bottom wall of the housing 14. An airflow control switch 83 is provided on the control unit 21 to vary the blower airflow to a desired amount. The greater the airflow, the more active the flame will appear. Alternatively, the flame effect element 58 may be moved mechanically to produce sufficient billowing or rippling to give the flame effect.

In use, light is transmitted from the light source 30 through the slits 66 of the flame effect element 58 to the diffusing surface 46 of the screen 42. The flame effect element 58 billows in the airflow from the blower 60 to vary the position and size of the slits 66. The resulting effect is for the transmitted light to resemble flames licking from a fire. As will be explained further below, the transmitted light is at least partially colored due to its reflecting from a colored reflecting surface 82 of a flicker element 62, 64 prior to passing through the slits 66.

Figure 6:
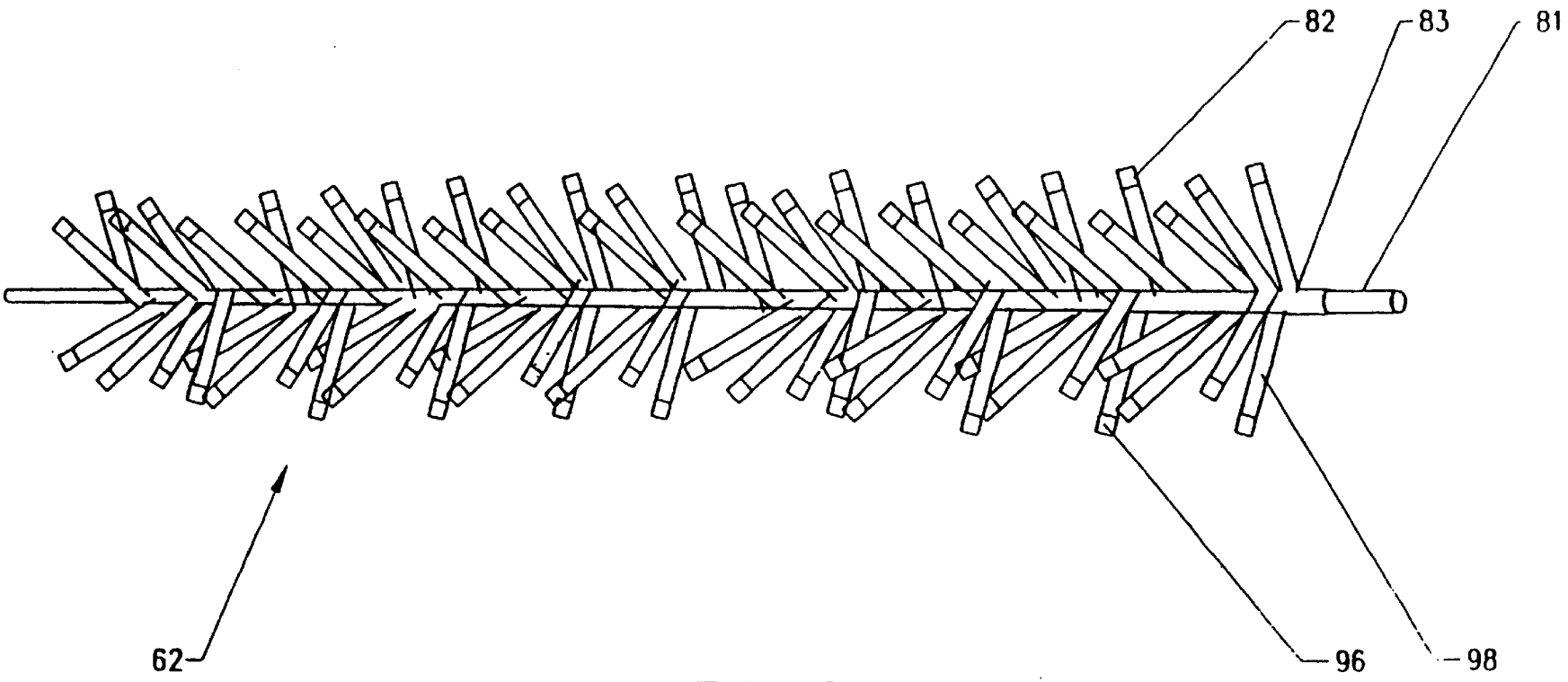
FIG. 6 is a perspective view of the upper flicker element for the assembly of FIG. 1, as viewed along direction arrow 6 in FIG. 3.
Figure 8:
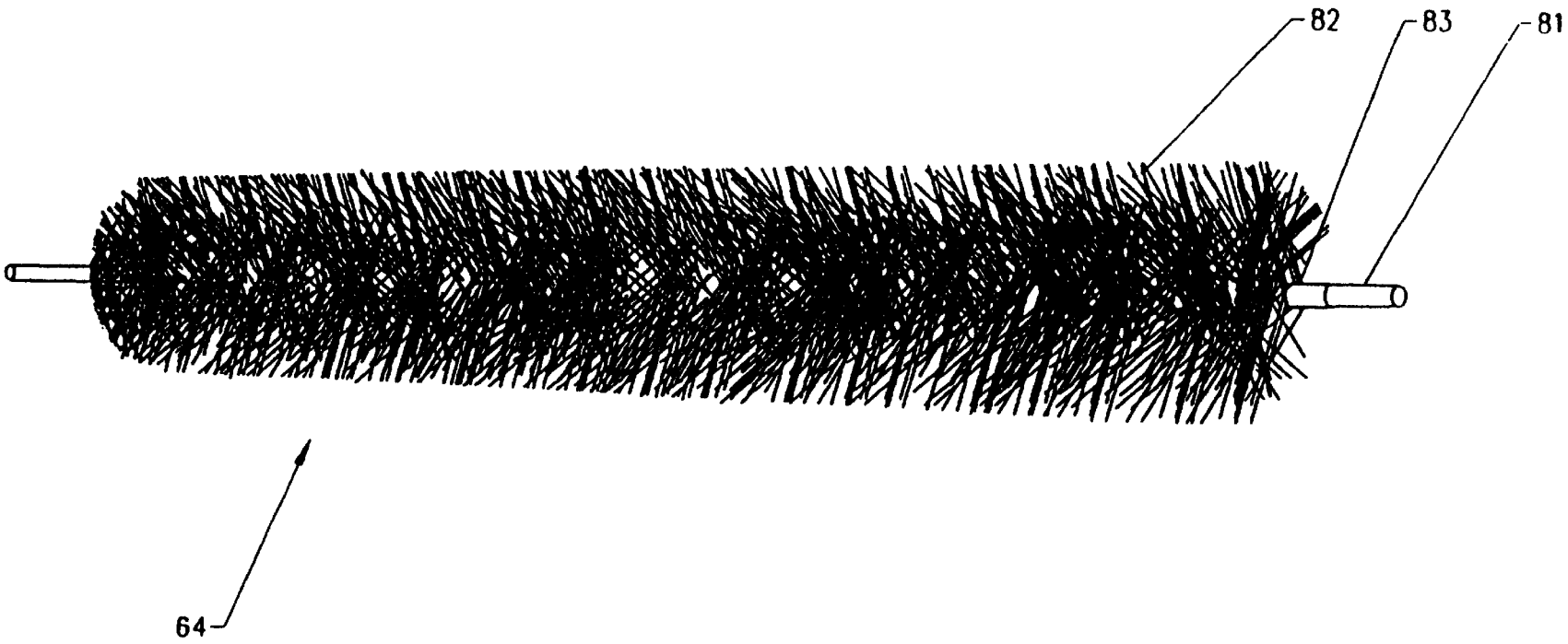
FIG. 8 is a perspective view of the lower flicker element for the assembly of FIG. 1, as viewed along direction arrow 8 in FIG. 3.

The upper and lower flicker elements 62, 64 are located rearwardly from the flame effect element 58 proximate to the rear wall of the housing 14. As shown in FIGS. 6 and 8, each flicker element comprises an elongate rod 81 having a plurality of reflective strips 82 extending radially outwardly therefrom. The flicker elements 62, 64 preferably have a diameter of about two to three inches. The strips 82 are formed from a length of material having a width of approximately one and a half inches. A series of transverse slits are cut along one elongate side of the length of the material 83 to define each individual strip 82. The length of material 83 is then wrapped about the rod 81 so that the strips 82 protrude radially about the full circumference of the rod 81. Alternatively, the strips 82 may be cut to lengths of around two to three inches and clamped at their centers by spiral wound wires that form the rod 81. Alternatively, the reflective surfaces of the flicker elements could be mirrored glass pieces arranged about the surface of a cylinder.

The rods 81 are supported at one end in corresponding recesses 84 defined in a vertical support arm 86 that is connected by fasteners 88 to the bottom wall of the housing 14. The rods 81 are connected at their other end to corresponding rotors 90 for rotating each rod 81 about its axis. The rotors 90 are rotated by electric motors 91 as shown. The rotors 90 are supported by a vertical support member 92 that is connected with fasteners 94 to the bottom wall of the housing 14. Alternatively, the rotor 90 may be rotated by air currents from the blower 60 engaging corresponding fins on the rotors. Preferably, the rotors 90 rotate the flicker elements 62, 64 in the direction indicated by arrow 93 in FIG. 2 so that an appearance of upward motion is imparted on the reflected light images. This simulates the appearance of upwardly moving gasses from a fire. It is contemplated that other means for simulating the appearance of upwardly moving gasses may be used. For instance, a light source (not shown) may be contained within a moving, partially opaque, screen (not shown) to produce the desired light effect. It is also contemplated that the flicker elements 62, 64 or the above described gas simulating means may be used alone without the flame effect element 58. It has been found that the use of the flicker elements 62, 64 alone produces a realistic effect although not as realistic as when used in combination with the flame effect element 58.

Referring to FIG. 2, it may be seen that the lower flicker element is positioned slightly below the horizontal level of the upper end of the fuel bed 26. This facilitates the appearance of upwardly moving gasses and colored flames emanating from near the surface of the fuel bed when viewed by a person in front of the fireplace. Similarly, the upper flicker element is positioned at a horizontal level above the fuel bed 26 to give the appearance of upwardly moving gasses and colored flames emanating a distance above the fuel bed when viewed by a person in front of the fireplace. In addition, the upper and lower flicker elements 62, 64 improve the light intensity of the simulated flame and gasses.

Figure 7:
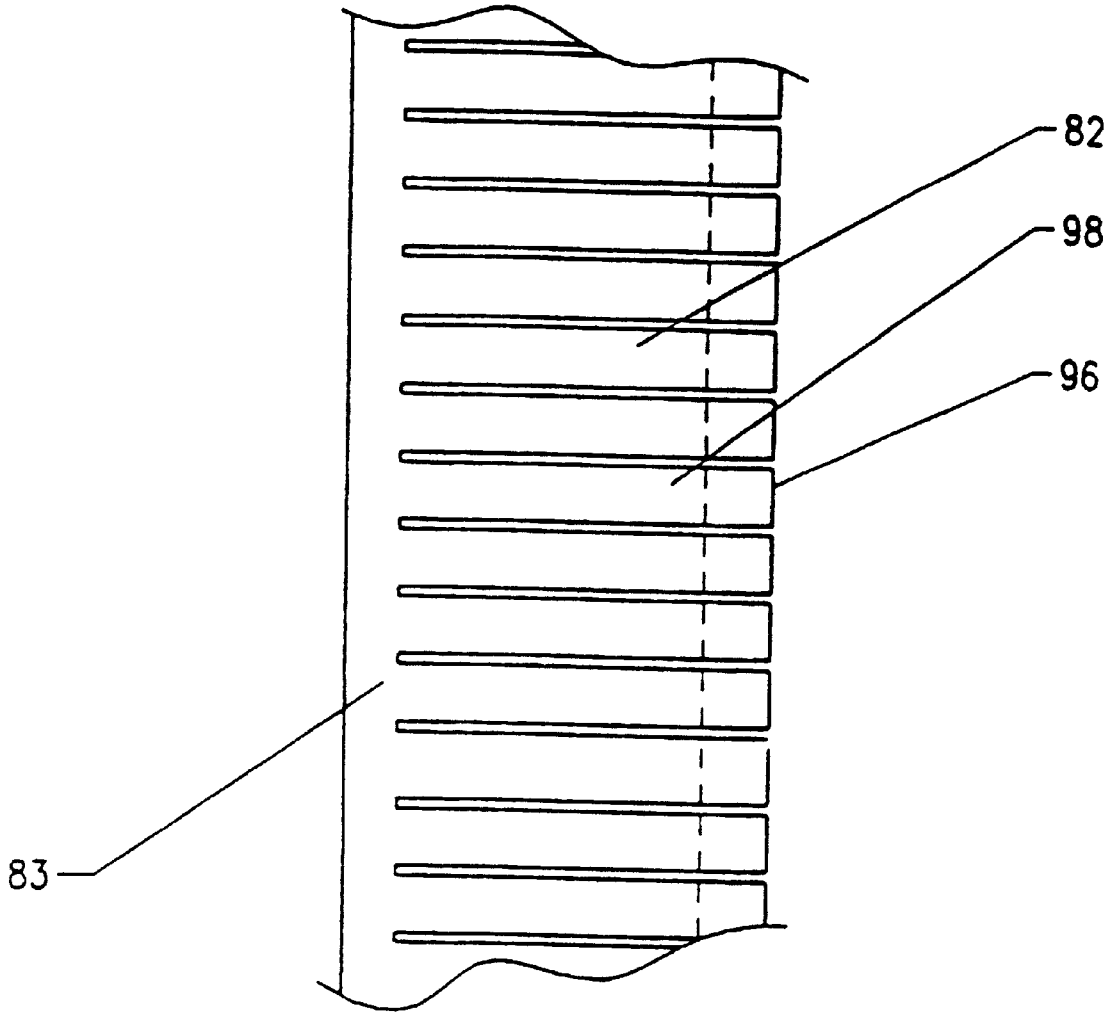
FIG. 7 is a partial plan view of a length of material defining a plurality of radial strips for the upper flicker element of FIG. 1.

Referring more closely to FIG. 7, the strips 82 for the upper flicker element 62 are shown. Each strip 82 is formed from a reflective material such as MYLAR™. The strip 82 is preferably colored with either a blue or red tip 96 and a silver body 98, although a fully silver body has been used successfully as well. A length of material 83 with red tipped strips 82 and a length of material 83 with blue tipped strips 82 may both be wrapped about the rod 81. As shown in FIG. 6, a combination of blue and red tipped strips 82 protrude radially from the rod 81 over the entire length of the flicker element 62. As a result, the upper flicker element 62 reflects white, red and blue light that is subsequently transmitted through the flame effect element 58.

The lower flicker element 64, as shown in FIG. 8, comprises a dense arrangement of thin strips 82 that are formed from a reflective material such as MYLAR™. The strips 82 are either substantially gold in color, or substantially red in color. A combination of lengths of material 83 with red strips 82 and gold strips 82 may be wrapped around the rod 81 to produce an overall red and gold tinsel appearance. As a result, the lower flicker element 64 reflects yellow and red light that is subsequently transmitted through the flame effect element 58.

In use, the flicker elements 62, 64 are rotated by the rotors 90 so that the reflective surfaces of the strips 82 reflect colors through the slits 66 of the billowing flame effect element 58 and produce the effect of upwardly moving gasses. The colors reflected by the lower flicker element 64 resemble the colors of flames located near the surface of the fuel bed 26. The colors reflected by the upper flicker element 62 resemble the colors of flames that are located further from the surface of the fuel bed 26. The upper flicker element 62 has a less dense arrangement of strips 82 in order to produce more random reflections that simulate a more active flickering flame at a distance above the fuel bed 26. The more dense arrangement of strips 82 in the lower flicker 64 produces relatively more constant reflections that simulate the more constant flame activity adjacent to the fuel bed 26.

Figure 10:
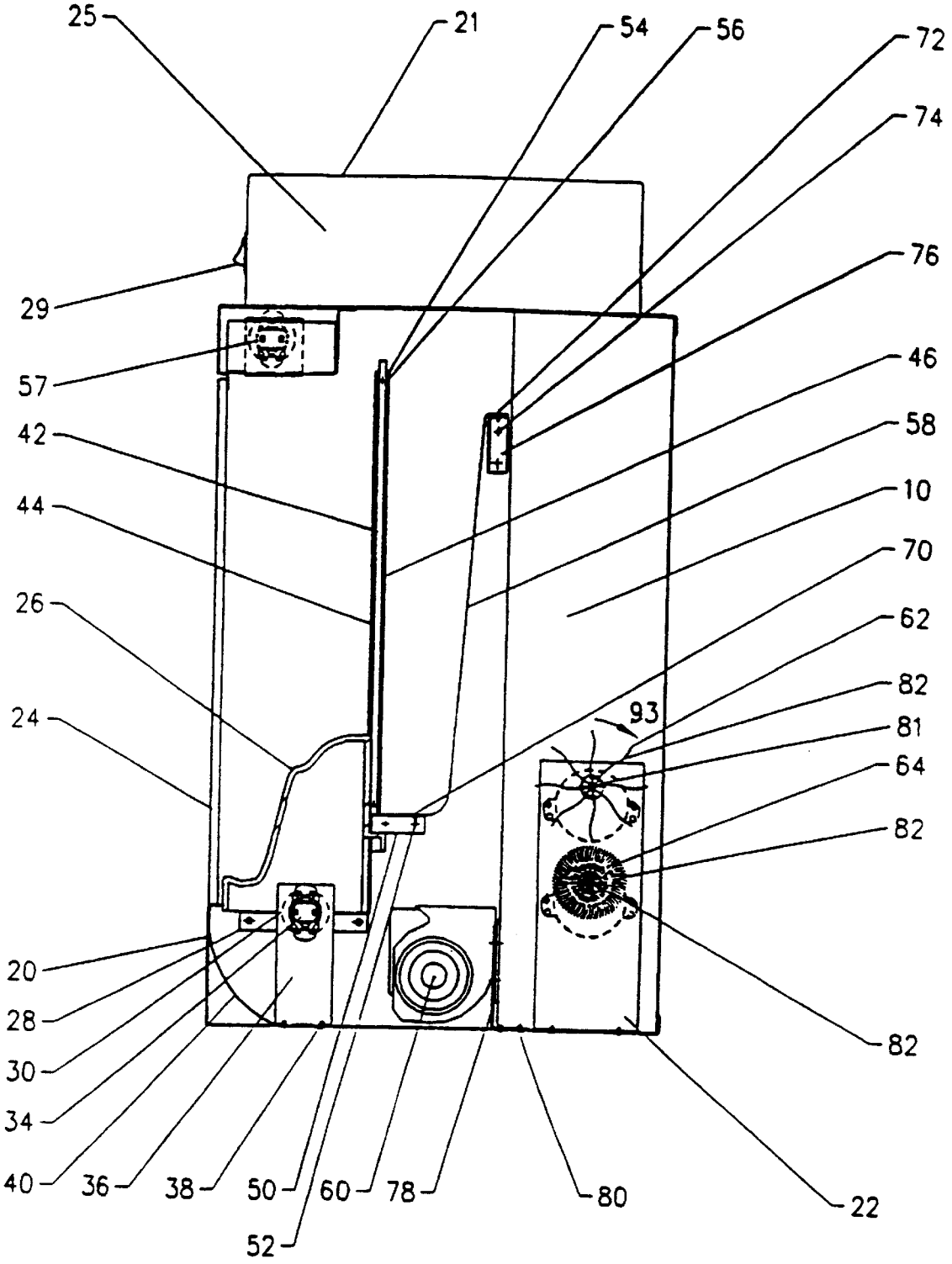
FIG. 10 is a side view of a second embodiment of the flame simulating assembly showing an alternative orientation of the flicker elements.

Referring to FIG. 10, an alternative orientation for the flicker element 62, 64 is shown. The upper flicker element 62 is positioned slightly below the horizontal level of the upper end of the fuel bed 26. The lower flicker element 64 is positioned slightly above the horizontal level of the lower end of the fuel bed 26. The lower flicker element 64 is positioned slightly above the horizontal level of the lower end of the fuel bed 26.

Figure 11:
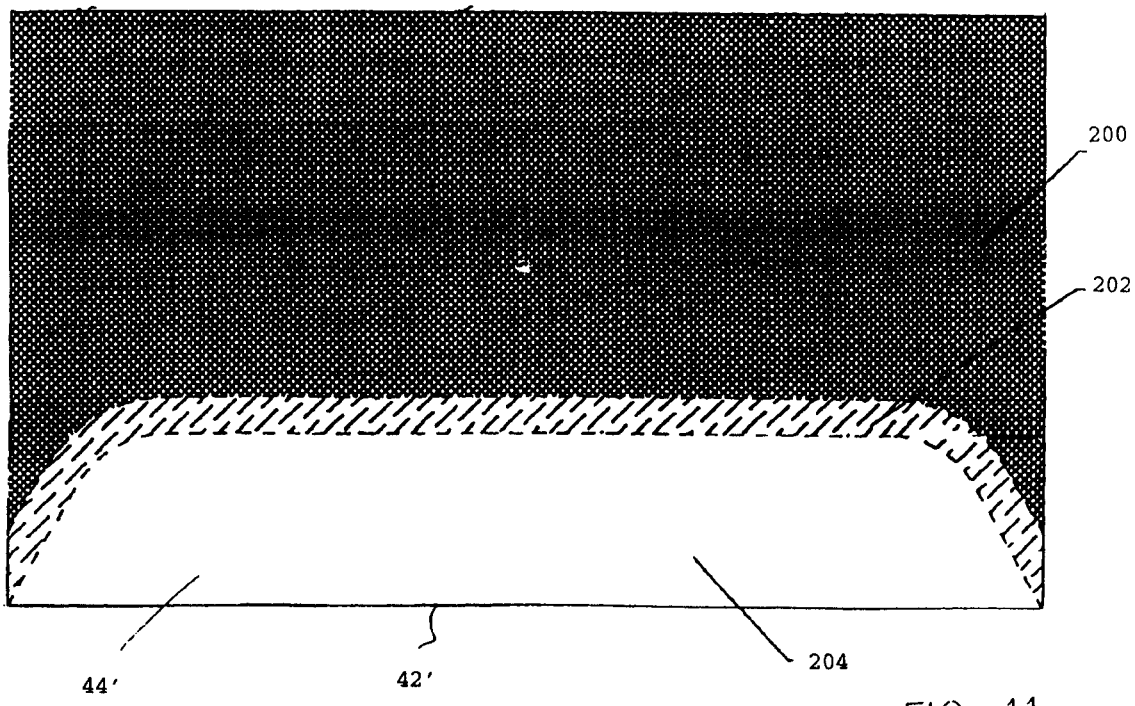
FIG. 11 is a front view of a second embodiment of the vertical screen showing the partially reflecting surface divided into regions.

Referring to FIG. 11, an improved vertical screen 42' is depicted. The front of the screen includes a partially reflecting surface 44' that is divided into a matte region 200, a transition region 202 and a reflecting region 204. The reflecting region 204 is located at the lower end of the vertical screen 42' and is sufficiently sized for reflecting the fuel bed 26 to produce the simulated effect. At the same time, the reflecting region 204 is not overly sized so as to reflect unwanted images such as the floor covering located immediately in front of the fireplace. For this reason, the vertical screen 42' includes the matte region 200 at its middle and upper end. The matte region 200 has a matte finish that does not reflect images while still permitting visibility of the simulated flame image through the vertical screen 42'. The transition region 202 comprises a gradual transition between the non-reflective matte region 200 and the reflecting region 204.

Figure 12:
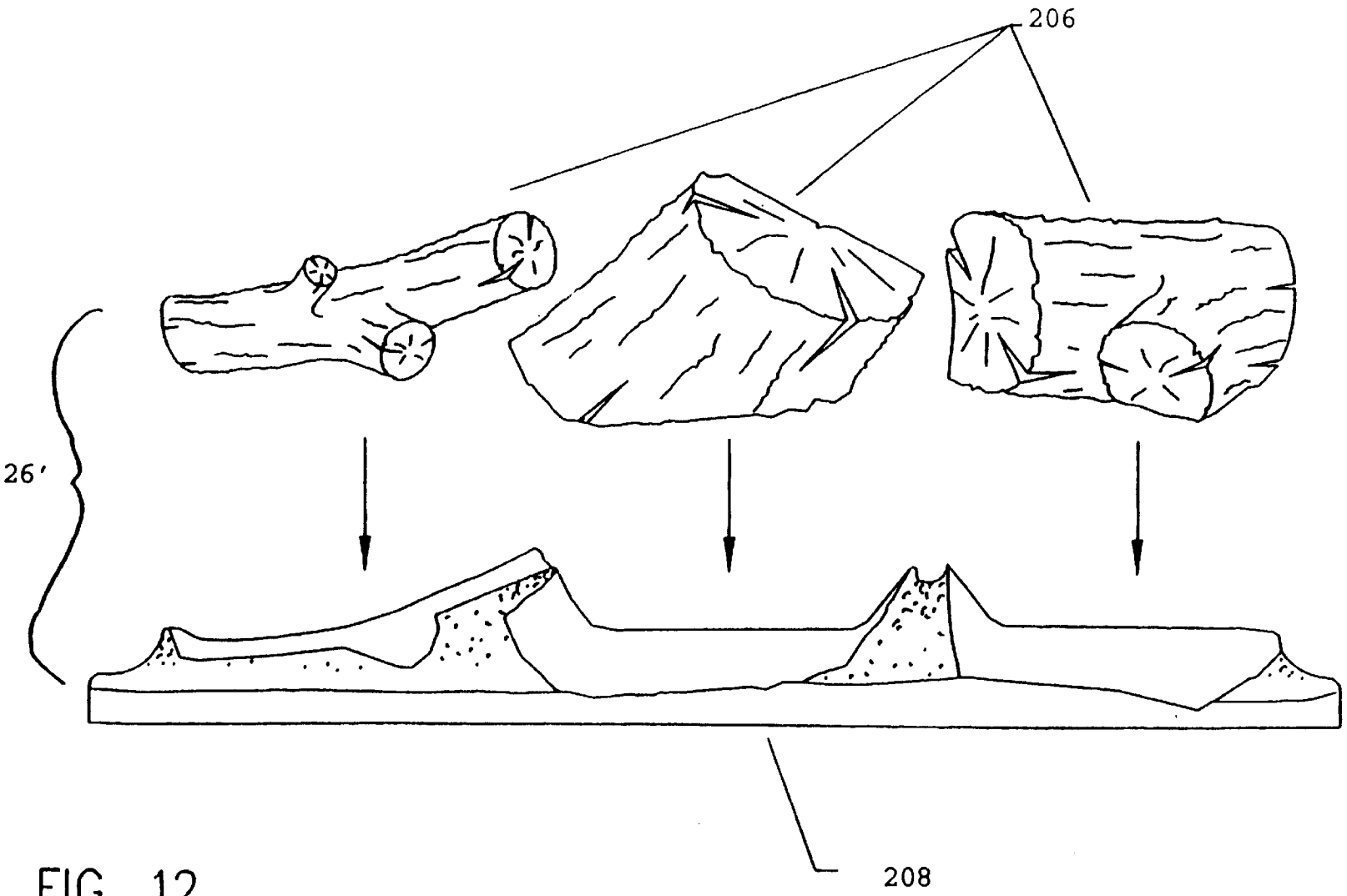
FIG. 12 is an exploded detail view of a second embodiment of the fuel bed.

Referring to FIG. 12, an improved fuel bed 26' is shown. The fuel bed 26' includes a first portion 206 composed of a ceramic material and formed and colored to simulate logs. The bed 26' also includes a second portion 208 composed of a plastic material and formed and colored to simulate an ember bed. The ember bed 208 is preferably translucent to permit the passage of light from the light source 30 or fuel bed light assembly 100 as described earlier. It has been found that a more accurate simulation of logs 206 can be accomplished using ceramic materials and flexible molds. The ember bed 208 can still be formed realistically from plastic using a vacuum forming method. The bed is formed to receive the ceramic logs 206. The ceramic logs 206 are then glued to the ember bed 208 to form the fuel bed.

Figure 13:
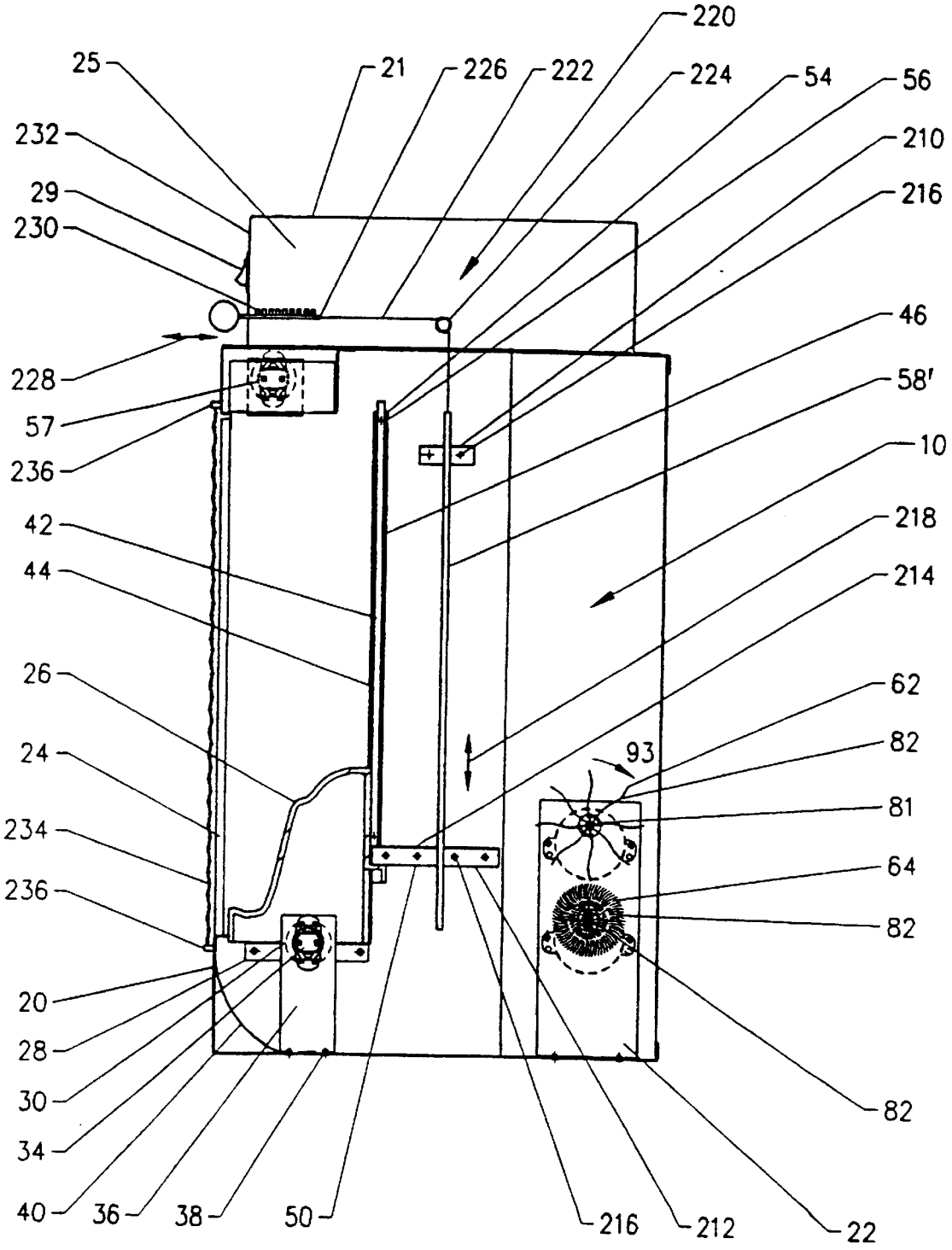
FIG. 13 is a side view of a third embodiment of the flame simulating assembly showing an alternative flame effect element.
Figure 14:
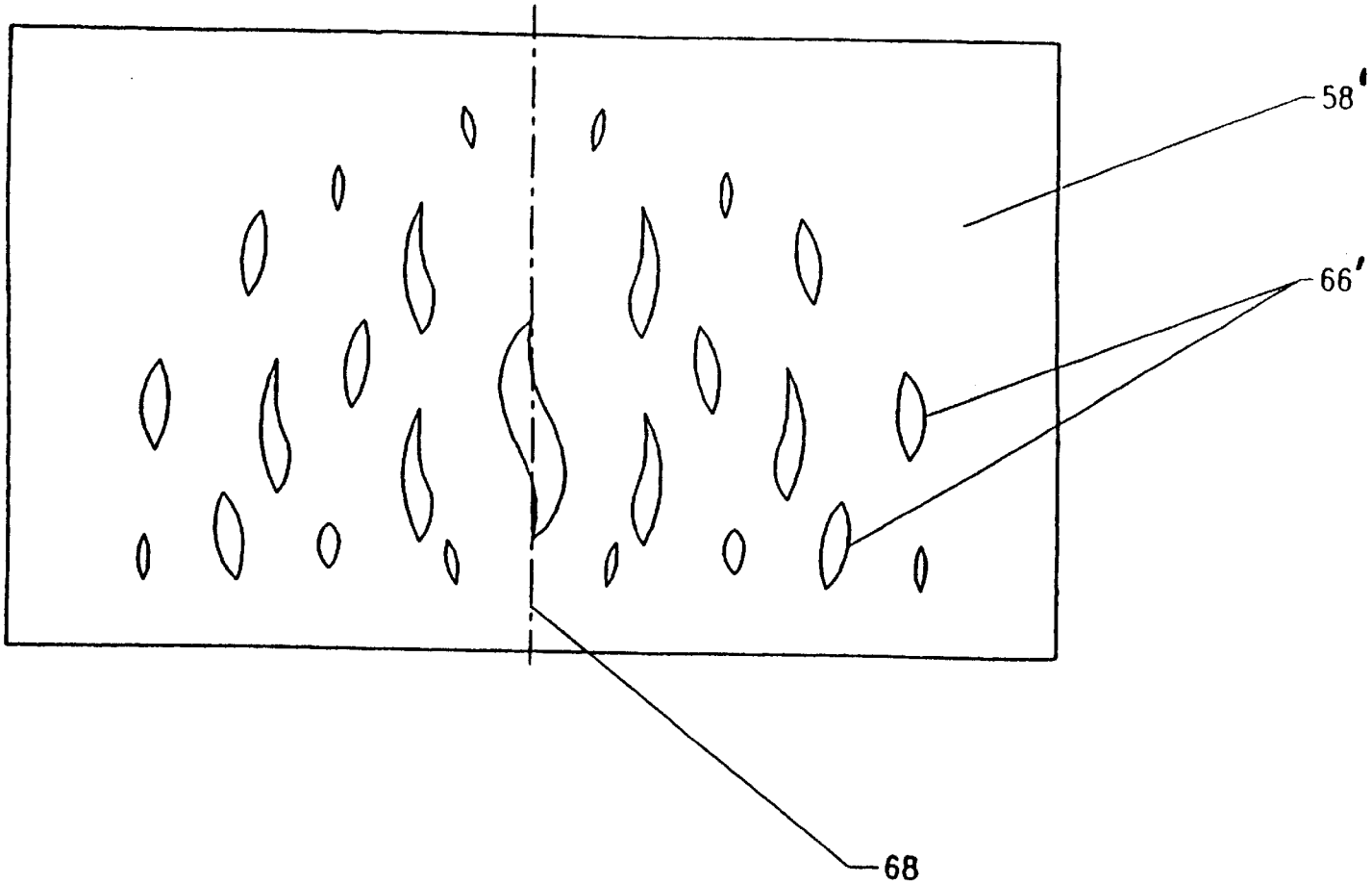
FIG. 14 is a front view of the flame effect element for the assembly of FIG. 13.

Referring to FIGS. 13 and 14, a third embodiment of the flame simulating assembly 10 is depicted. For convenience, the same reference numbers have been used to refer to the same elements. The third embodiment does not include the blower 60 or the light-weight flame effect element 58 which was adapted to billow in the airflow of the blower. Instead, an improved flame effect element 58' is positioned behind and substantially across the full width of the screen 42. The improved flame effect element 58' is similar in appearance to the flame effect element 58 depicted in FIG. 5. However, the improved flame effect element 58' is positioned preferably in a generally vertical plane approximately three inches behind the screen 42 (and about ½ inch from the flicker elements 62, 64). The element 58' is preferably formed of a more rigid material (e.g. plastic or thin steel) so that it will remain generally stationary in its vertical position. However, a light-weight material such as polyester may be used instead with the element 58' being stretched taut into a vertical position. Furthermore, it should be understood that a vertical position for the element 58' is not critical, so long as light passage is possible as described below.

A plurality of slits 66' are cut into the flame effect element 58' to permit passage of light from the light source 30 through the flame effect element 58' to the screen 42. While the improved flame effect element 58' remains relatively stationary, the flame simulation effect is nonetheless observable due to the reflection of light from the flicker elements 62 and 64 as the light passes through the slits 66'.

The improved flame effect element 58' is sandwiched between upper and lower support elements 210 and 212 to support the flame effect element in a generally vertical position. The lower horizontal support member 50 acts as one of the lower support elements. In addition, lower horizontal support member 50 acts as a horizontal opaque screen 214 to block light from passing below the screen 42 and flame effect element 58'. In this manner, substantially all of the light reaching the screen 42 has been reflected by flicker elements 62 and 64 and passes through slits 66' in the flame effect element 58'. The upper and lower support elements 210 and 212 are fastened to the side walls 23 of the housing 14 with fasteners 216.

Alternatively, the element 58' could be formed with a horizontal living hinge at its lower end. The portion below the living hinge could be connected to the screen 42 and act as the horizontal opaque screen 214. The portion above the screen should be supported at least at its upper end by the upper support element 210. The living hinge allows the element 58' to be moved up or down as described below.

The flame effect element 58' is preferably movable upwardly or downwardly relative to the screen 42 in the direction of arrows 218. This is accomplished by a height adjustment mechanism shown generally at 220. The mechanism 220 includes a wire 222 connected to the top of the flame effect element 58'. The wire 222 extends over a pin 224 and connects at its other end to the end of a height adjusting knob 226. The height adjusting knob 226 protrudes from the front of the control unit 21 and is capable of being moved inwardly and outwardly relative to the front face of the control unit 21 in the direction of arrows 228. The height adjusting knob 226 includes a plurality of teeth 230 that engage the front face 232 of the control unit 21 to permit the knob 226 to be secured inwardly or outwardly relative to the control unit 21 in one of a plurality of positions. It has been found that, by raising or lowering the flame effect element 58' by a predetermined amount, the perceived intensity of the simulated flame (both the brightness and size of the flame) effect can be increased or decreased. It is believed that this change in intensity is due to the different sized slits 66' defined in the flame effect element 58' being more or less visible to an observer positioned in front of the fireplace 12. It will be appreciated that alternative height adjustment mechanisms may be chosen. For instance, the knob 226, may be connected to the flame effect element 58' by a cam arrangement for mechanically moving the element 58' up or down.

The embodiment depicted in FIG. 13 further includes a simulated fire screen 234 covering the front face 232 of the transparent front panel 24. The simulated fire screen 234 is preferably a woven mesh such as is known for blocking sparks for conventional fireplaces. The woven mesh fire screen 234 is supported at its top and bottom ends by pins 236 protruding from the front wall 20 of the housing 14. Alternatively, the simulated fire screen 234 can be defined directly on the transparent front panel 24 using a silk screen process or the like. It has been found that the simulated fire screen 234 reduces any glare or reflection that otherwise might be visible on the transparent front panel 24.

It is to be understood that what has been described is a preferred embodiment to the invention. The invention nonetheless is susceptible to certain changes and alternative embodiments fully comprehended by the spirit of the invention as described above, and the scope of the claims set out below.

We claim:

1. A simulated fireplace assembly having:

a simulated fuel bed;

a light source; and a screen having a partially reflective front surface disposed behind the simulated fuel bed for reflecting and transmitting light, and a back surface disposed behind the partially reflective front surface for transmitting light, the partially reflective front surface having a substantially non-reflective matte region, the non-reflective matte region being disposed distal from the simulated fuel bed, and the portion of the front surface not covered by the non-reflective matte region being a reflective region, such that the simulated fuel bed is substantially the only object reflected in the front surface, wherein light from the light source is transmitted through the front surface such that an image of flames appears through the front surface.

2. A simulated fireplace assembly as defined in claim 1 wherein the front surface further includes a transition region which is partially reflective and partially non-reflective, the transition region being disposed between the non-reflective matte region and the reflective region.

3. A simulated fireplace assembly having:

a simulated fuel bed;

a light source;

a screen having a partially reflective front surface disposed behind the simulated fuel bed for reflecting and transmitting light, and a diffusing back surface disposed behind the partially reflective front surface for diffusing and transmitting light;

a flicker element positioned in a path of light transmitted from the light source to the diffusing back surface; and the partially reflective front surface having a substantially non-reflective matte region, the non-reflective matte region being disposed distal from the simulated fuel bed, and the portion of the front surface not covered by the non-reflective matte region being a reflective region, such that the simulated fuel bed is substantially the only object reflected in the front surface, wherein light from the light source is transmitted through the front surface such that an image of flames appears through the front surface.

4. A simulated fireplace assembly as defined in claim 3 wherein the front surface further includes a transition region which is partially reflective and partially non-reflective, the transition region being disposed between the non-reflective matte region and the reflective region.

5. A simulated fireplace assembly having:

a simulated fuel bed;

a light source;

a screen having a partially reflective front surface disposed behind the simulated fuel bed for reflecting and transmitting light, and a diffusing back surface disposed behind the partially reflective front surface for diffusing and transmitting light;

a flicker element positioned in a path of light transmitted from the light source to the diffusing back surface;

a flame effect element positioned in the path of light, for configuring light; and the partially reflective front surface having a substantially non-reflective matte region, the non-reflective matte region being disposed distal from the simulated fuel bed, and the portion of the front surface not covered by the non-reflective matte region being a reflective region, such that the simulated fuel bed is substantially the only object reflected in the front surface, wherein light from the light source is transmitted through the front surface such that an image of flames appears through the front surface.

6. A simulated fireplace assembly as defined in claim 5 wherein the front surface further includes a transition region which is partially reflective and partially non-reflective, the transition region being disposed between the non-reflective matte region and the reflective region.

* * * * *